US009306335B2

(12) United States Patent
Fan et al.

(10) Patent No.: US 9,306,335 B2
(45) Date of Patent: Apr. 5, 2016

(54) ELECTRICAL CONNECTOR WITH DIFFERENTIAL PAIR CONTACT

(71) Applicant: HON HAI PRECISION INDUSTRY CO., LTD., New Taipei (TW)

(72) Inventors: Ding-Bing Fan, Kunshan (CN); Hong-Qiang Han, Kunshan (CN); Hao Zhou, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/317,655

(22) Filed: Jun. 27, 2014

(65) Prior Publication Data

US 2015/0004816 A1 Jan. 1, 2015

(30) Foreign Application Priority Data

Jun. 27, 2013 (CN) ..... 2013 2 03747703 U

(51) Int. Cl.

| | |
|---|---|
| ***H01R 13/6471*** | (2011.01) |
| *H01R 12/72* | (2011.01) |
| *H01R 13/518* | (2006.01) |
| *H01R 13/646* | (2011.01) |
| *H01R 13/6594* | (2011.01) |

(52) U.S. Cl.

CPC ..... *H01R 13/6471* (2013.01); *H01R 12/724* (2013.01); *H01R 13/518* (2013.01); *H01R 13/646* (2013.01); *H01R 13/6594* (2013.01)

(58) Field of Classification Search

CPC ..... H01R 13/6471; H01R 13/518; H01R 13/659; H01R 27/02

USPC ..... 439/607.23, 540.1, 638, 660, 541.5, 439/941, 101, 108

See application file for complete search history.

(56) References Cited

U.S. PATENT DOCUMENTS

| | | | | |
|---|---|---|---|---|
| 6,350,134 | B1 * | 2/2002 | Fogg et al. | 439/79 |
| 6,835,092 | B2 * | 12/2004 | Wan et al. | 439/541.5 |
| 7,303,410 | B2 * | 12/2007 | Saito | 439/108 |
| 7,435,110 | B2 * | 10/2008 | Xiao et al. | 439/107 |
| 7,988,487 | B2 * | 8/2011 | Nomiyama et al. | 439/541.5 |
| 8,070,529 | B2 * | 12/2011 | Xiong et al. | 439/676 |
| 8,894,451 | B2 * | 11/2014 | Shiratori et al. | 439/885 |

FOREIGN PATENT DOCUMENTS

| | | |
|---|---|---|
| TW | M392473 | 11/2010 |

* cited by examiner

*Primary Examiner* — Felix O Figueroa
*Assistant Examiner* — Paul Baillargeon
(74) *Attorney, Agent, or Firm* — Wei Te Chung; Ming Chieh Chang

(57) ABSTRACT

An electrical connector comprises an insulative block, a plurality of contacts received in the insulative block. The contacts each include a retaining portion retaining in the insulative block, a contacting portion extending forwardly from the retaining portion and a soldering portion. The contacts include a plurality of differential signal contacts and a plurality of grounding contacts. The soldering portion of differential signal contacts arranged to a plurality of rows and the soldering portion of grounding contacts arranged to a plurality of another rows which parallel to the row of the differential contacts. The row of the differential contacts and the row of the grounding contacts are spaced from each other.

20 Claims, 10 Drawing Sheets

ELECTRICAL CONNECTOR WITH DIFFERENTIAL PAIR CONTACT

BACKGROUND OF THE INVENTION

1. Field of the Invention

The present invention generally relates to an electrical connector and more particularly to an electrical connector with differential pair contacts retained to an insulative housing of the electrical connector.

2. Description of Related Art

Taiwan patent No. TW M392473, published on Nov. 11, 2010, discloses an electrical connector including a upper connector and a bottom connector stacked with the upper connector. The upper connector include a upper contacts having a first soldering portion extending downwardly and a bottom connector include a bottom contacts having a second soldering portion. The upper and bottom contacts each include a plurality of differential signal contacts and a plurality of grounding contacts. The first soldering portion of the upper contacts are arranged hybrid. Thus, the cross-talk between the upper connector and the bottom connector would be influence the signal transmission quality of the electrical connector.

So, an improved connector is needed.

SUMMARY OF THE INVENTION

The present invention provides an electrical connector comprises an insulative block, a plurality of contacts received in the insulative block. The contacts each include a retaining portion retaining in the insulative block, a contacting portion extending forwardly from the retaining portion and a soldering portion. The contacts include a plurality of differential signal contacts and a plurality of grounding contacts. The soldering portion of differential signal contacts arranged to a plurality of rows and the soldering portion of grounding contacts arranged to a plurality of another rows which parallel to the row of the differential contacts. The row of the differential contacts and the row of the grounding contacts are spaced from each other.

Other objects, advantages and novel features of the present invention will become more apparent from the following detailed description of the present embodiment when taken in conjunction with the accompanying drawings.

DETAILED DESCRIPTION OF THE INVENTION

Figure 1:
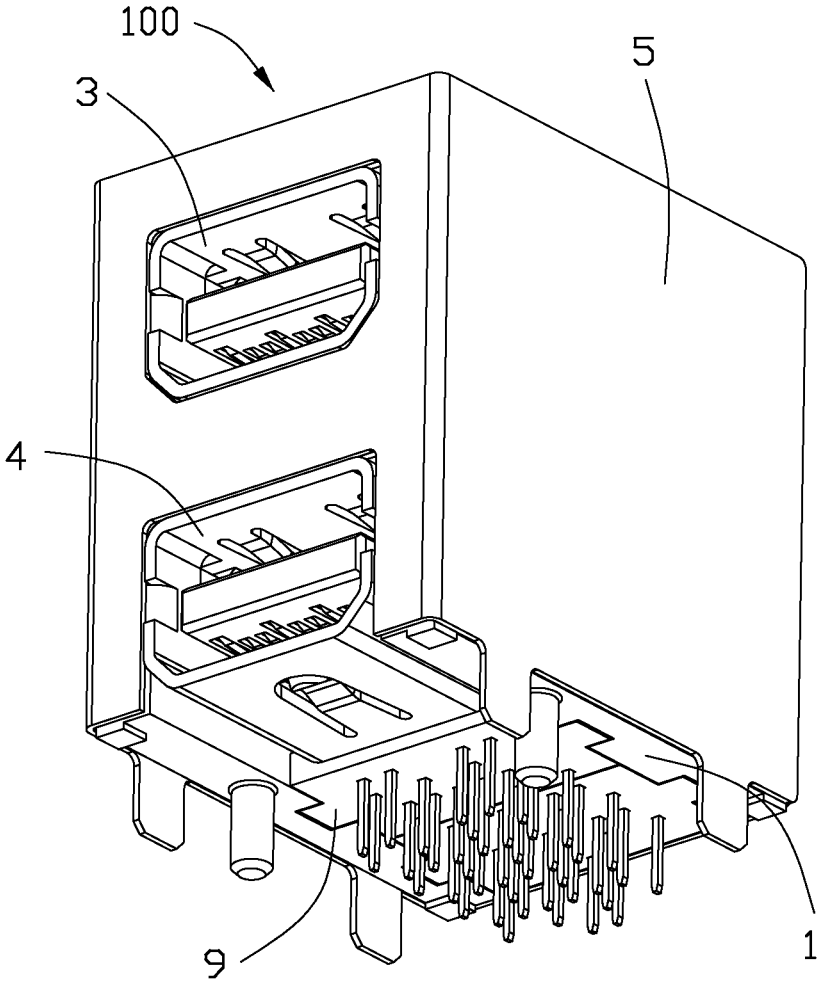
FIG. 1 is an assembled perspective view of an electrical connector according to a preferred embodiment of the present invention.

Reference will now be made to the drawing figures to describe the preferred embodiment of the present invention in detail.

Referring to FIG. 1, an electrical connector 100 is used for mounting into the print circuit board and comprises two mating port for receiving two mating plug (not shown) inserting into. The electrical connector 100 comprises a insulative hosing 1, a first connector 3, a second connector 4, a spacer 9 mounted into the insulative housing 1 and a covering shell 5 covering around the insulative housing 1.

Figure 5:
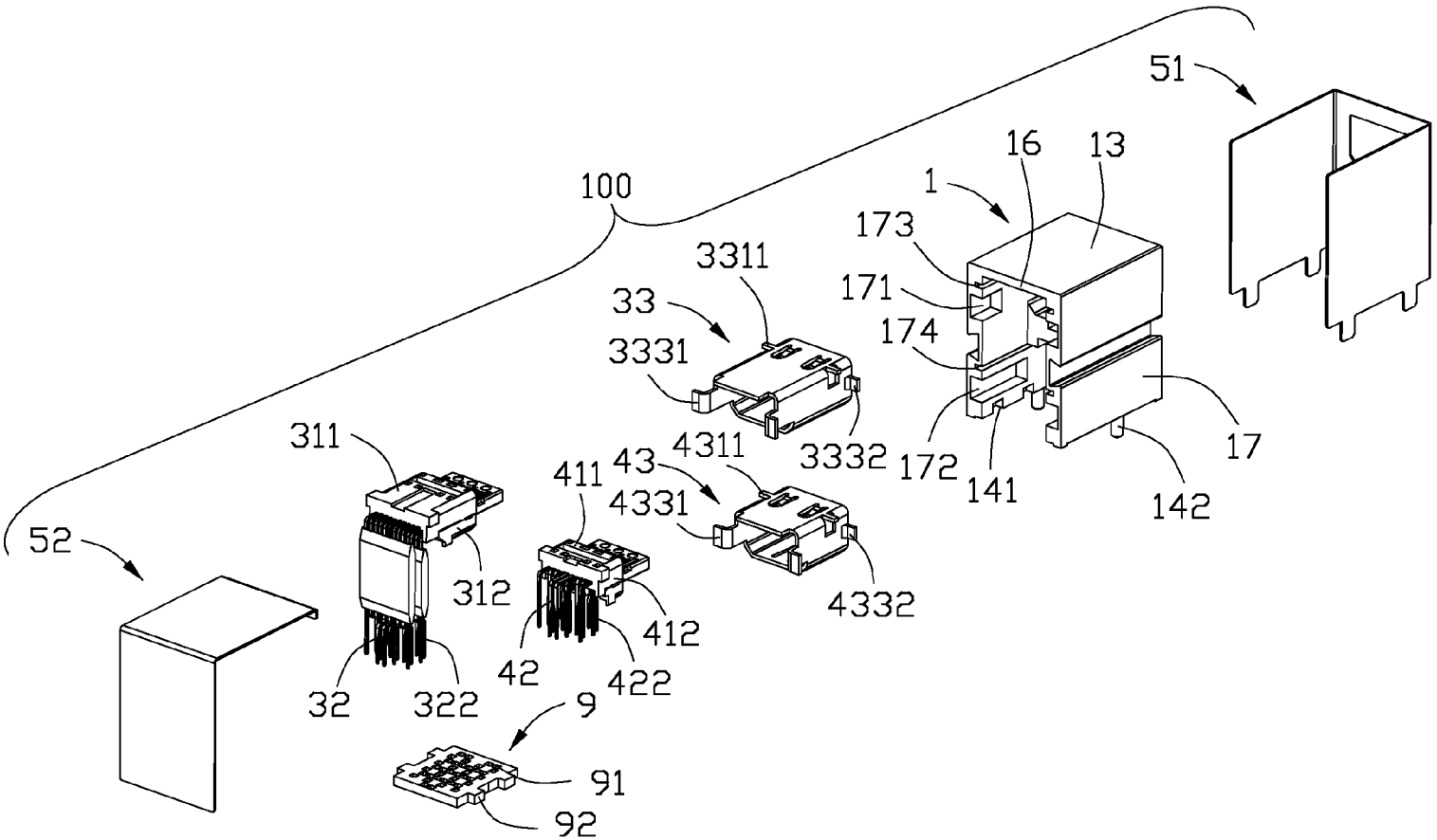
FIG. 5 is similar with FIG. 4, but taken from another side.

Referring to FIGS. 1-4, the insulative housing 1 comprises a top mounting space 11 and a bottom mounting space 12. The first connector 3 is mounted in the top mounting space 11 and the second connector 4 is mounted in the bottom mounting space 12. The insulative housing 1 includes a top wall 13, a bottom wall 14, a front wall 15, a back wall 16 and two side walls 17. The top mounting space 11 and a bottom mounting space 12 pass through the insulative housing 1 along a front to rear direction. The bottom mounting space 12 pass through the bottom wall 14 downwardly. Referring to FIG. 5, the side walls 17 of the insulative housing 1 each includes a pair of first passageway slot 171 located in the top mounting space 11 and a pair of second passageway slot 172 located in the bottom mounting space 12. The first passageway slot 171 is located in a top of the second passageway slot 172. The first and second passageway slot 171, 172 all pass through the insulative housing 1 backwardly. The insulative housing 1 also includes a first guiding slot 16 depressed the back wall 16 forwardly and a second guiding slot 174 depressed the back wall 16 forwardly. The first guiding slot 173 is located in the top of the first passageway slot 171 and the second guiding slot 174 is located in the top of the second passageway slot 172. The bottom wall 14 of the insulative housing 1 includes a plurality of retaining slot 141 depressed upwardly thereof and a plurality of retaining post 142 extending downwardly therefrom. The retaining posts 142 are located in the front of the retaining slot 141.

Figure 6:
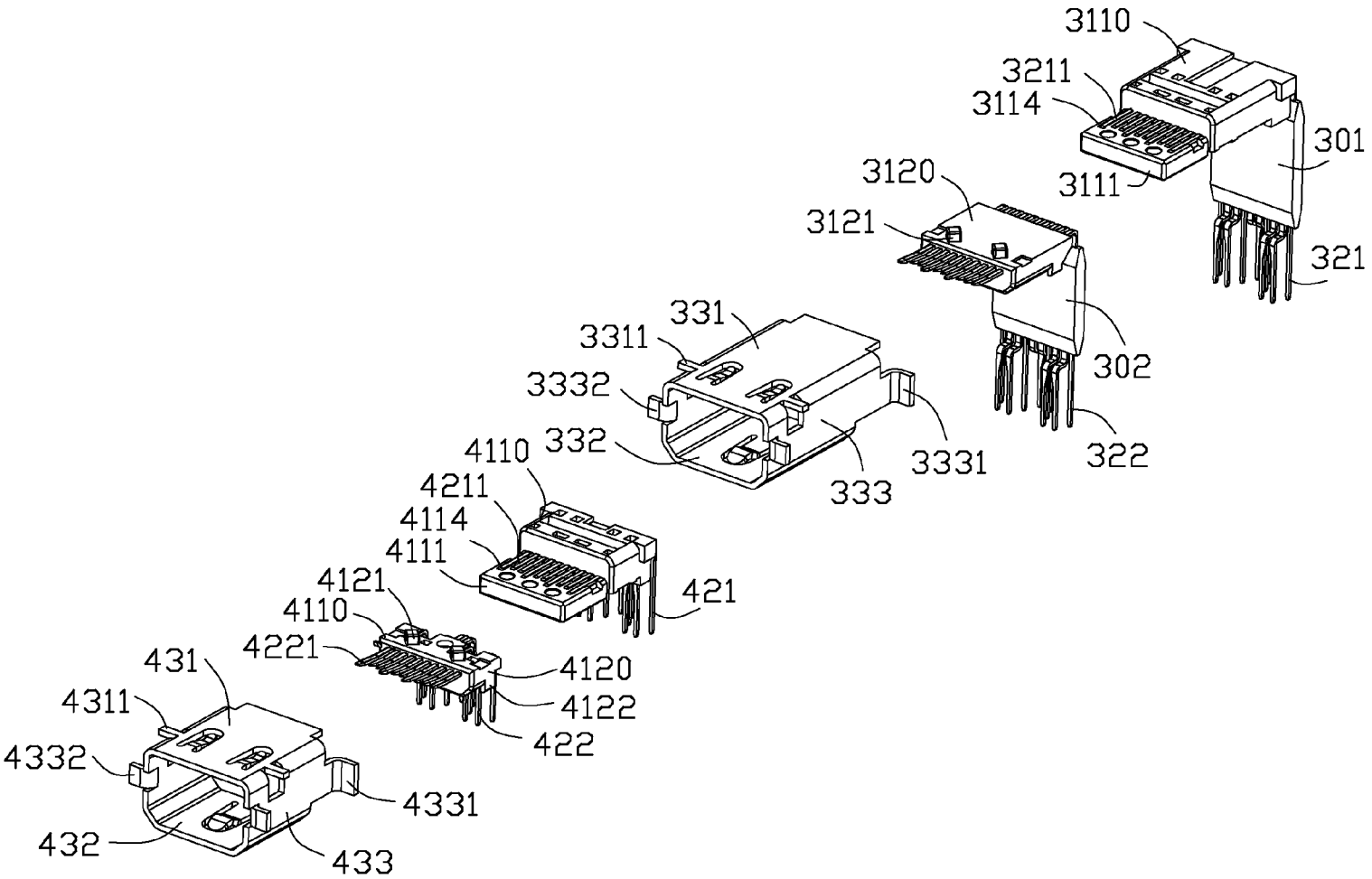
FIG. 6 is exploded view of a first electrical connector and a second electrical connector.
Figure 7:
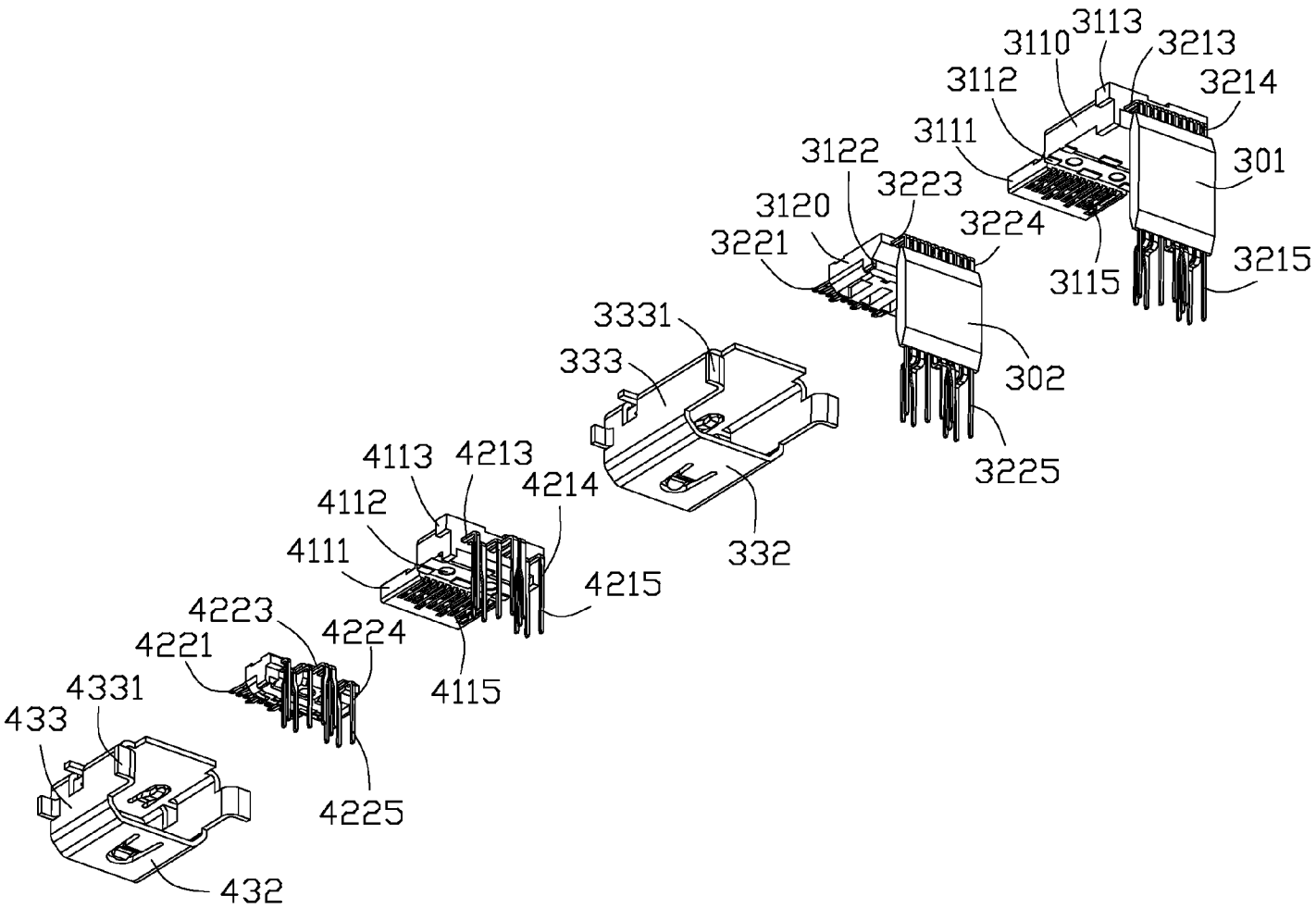
FIG. 7 is similar with FIG. 6, but taken from another side.

Referring to FIGS. 5-7, the first connector 3 comprises a upper insulative housing 31 having a first insulative block 311 a second insulative block 312 mounted into the first insulative block 311, a upper contact 32 receiving in the upper insulative housing 31 and a first shell 33 covering the upper insulative block 31. The first insulative block 311 includes a first body portion 3110 and a first tongue 3111 extending forwardly from the first body portion 3110. The bottom surface of the first body portion 311 includes a plurality of first receiving slots 3112 and a pair of the first resisting block 3113 extending outwardly from a rear thereof. The second insulative block 312 includes a second body portion 3120 having a plurality of first protruding portions 3121 matching up with the first receiving slots 3112 of the first insulative block 311. The first tongue 3111 includes a plurality of first accommodating slot 3114 located in an upper surface thereof and a plurality of second accommodating 3115 located in a bottom surface thereof. The second body portion 3120 has a plurality of first retaining blocks 3112 extending downwardly from a bottom thereof.

Figure 8:
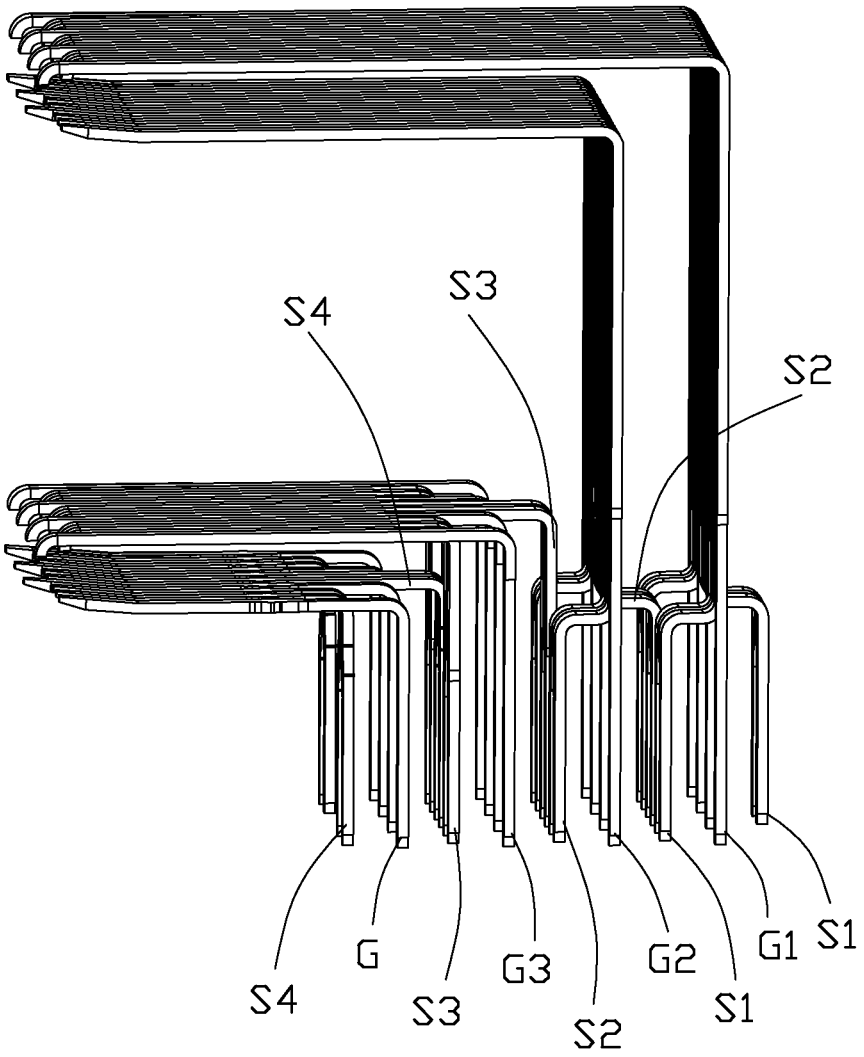
FIG. 8 is a perspective view of a plurality of contacts of the electrical connector.
Figure 9:
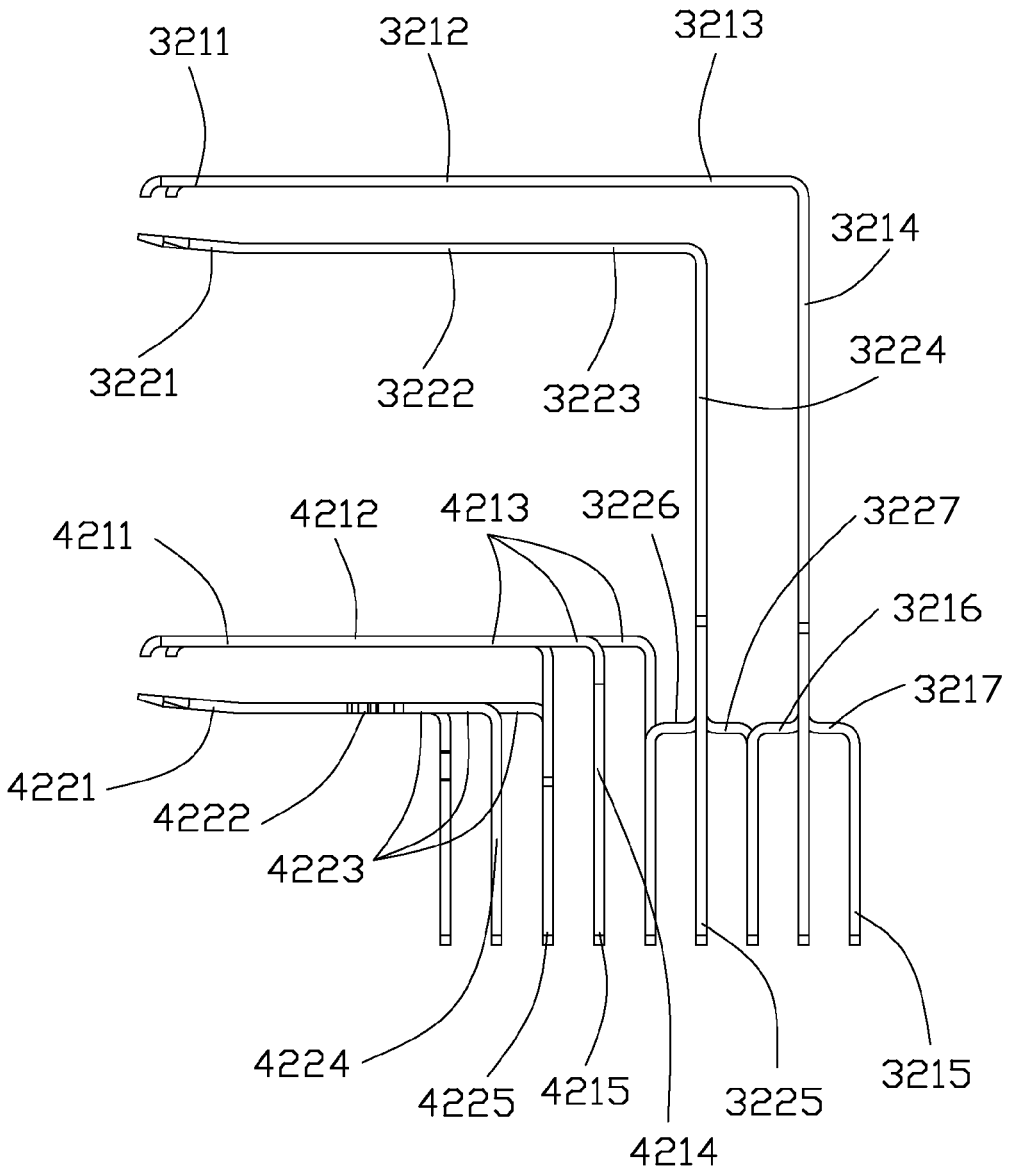
FIG. 9 is similar with FIG. 8, but taken from another side.
Figure 10:
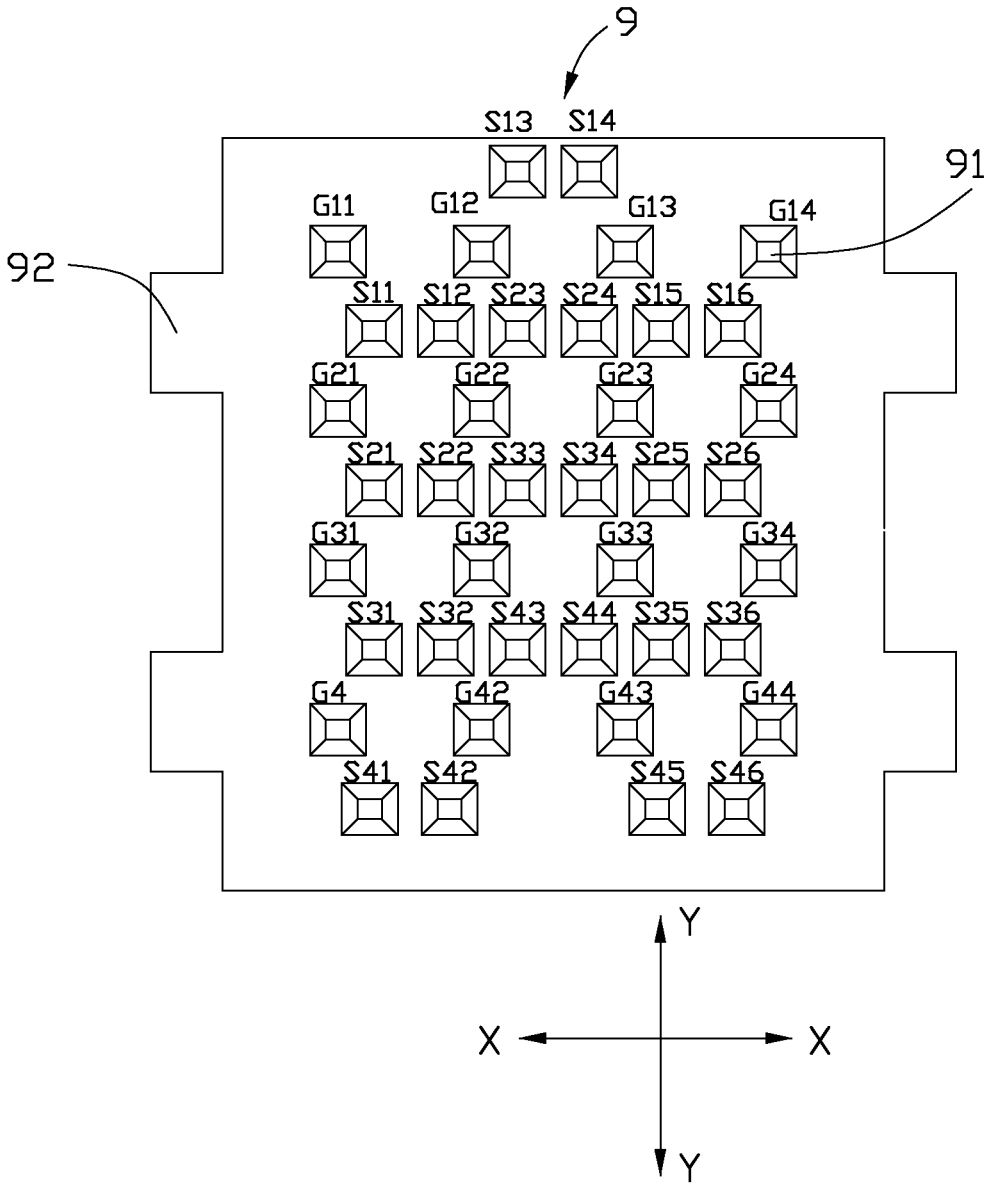
FIG. 10 is a spacer view of the electrical connector.

Referring to FIGS. 8-10, the upper contact 32 includes a first group of contact having ten first contacts 321 and a second group of the contact having ten second contacts 322. The first contacts 321 each includes a first retaining portion 3212 retaining in the first body portion 3110, a first contacting portion 3211 extending forwardly from the first retaining portion 3212 and receiving in the first accommodating slot 3114 of the first tongue 3111, a first horizontal portion 3213 extending backwardly from the first retaining portion 3213 and extending out of the first body portion 3110 and a first extending portion 3214 extending downwardly and vertical of a rear of the first horizontal portion 3213 and a first soldering portion 3215. The first contacts 321 include a plurality of differential signal contacts and a plurality of grounding contacts. A pair of grounding contacts has a pair of differential signal contacts located therebetween. Respectively, the first contacts 321 are G11, S11, S12, G12, S13, S14, G13, S15, S16, G14. The first soldering portion 3215 of the grounding contacts G11, G12, G13, G14 extend downwardly, and the first extending portion 3214 of the differential contacts S11, S12, S15, S16 have a first bending portion 3216 extending forwardly therefrom. The first soldering portion 4215 of the differential signal contacts S11, S12, S15, S16 extend downwardly from the first bending portion 3216. The first extending portion 3214 of the differential signal contact S13, S14 has a second bending portion 3217 extending backwardly and vertically from the first extending portion 3214. The first soldering portion 3215 of the differential signal S13, S14 extend downwardly from the second bending portion 3217. To observe along left and right directions, the first extending portions 3214 of the first contacts 321 are arranged in one row along the front to rear direction. The corresponding first soldering portions 3215 are arranged in three rows along the front to rear direction. The first soldering portion 3215 of the grounding contacts G11, G12, G13, G14 are located in the middle row of the three rows.

The second contacts 322 each include a second retaining portion 3222 retained in the second body portion 3120, a second contacting portion 3221 extending forwardly from the second retaining portion 3222, a second horizontal portion 3223 extending backwardly from the second retaining portion 3223, a second extending portion 3224 extending downwardly and vertical of a rear of the second horizontal portion 3223 and a second soldering portion 3225. The second contacts 322 include a plurality of differential signal contacts and a plurality of grounding contacts. A pair of grounding contacts has a pair of differential signal contacts located therebetween. Respectively, the second contacts 322 are G21, S21, S22, G22, S23, S24, G23, S25, S26, G24. The second soldering portion 3225 of the grounding contacts G21, G22, G23, G24 extend downwardly, and the second extending portion 3224 of the differential contacts S21, S22, S25, S26 have a third bending portion 3226 extending forwardly therefrom. The second soldering portion 3225 of the differential signal contacts S21, S22, S25, S26 extend downwardly from the third bending portion 3226. The second extending portion 3224 of the differential signal contact S23, S24 has a fourth bending portion 3227 extending backwardly and vertically from the second extending portion 3224. The second soldering portion 3225 of the differential signal S23, S24 extend downwardly from the fourth bending portion 3227. To observe along left and right directions, the second extending portions 3224 of the second contact 322 are arranged in one row along the front to rear direction. The corresponding second soldering portions 3225 are arranged in three rows along the front to rear direction. The second soldering portion 3225 of the grounding contacts G21, G22, G23, G24 are located in the middle row of the three rows.

The first insulative block 311 and the second insulative block 312 are mounted along the upper and bottom direction. The first protruding portions 3121 of the second insulative block 312 are received in the first receiving slot 3112 of the first insulative block 311 to make the first and second insulative blocks retain. The second contacting portion 3221 is received in the second accommodating slot 3115 of the first tongue 3111 and disposed outside downwardly. Referring to FIG. 10, the spacer 9 has a plurality of through holes 91 passing therethrough along the up to down direction and labeling the corresponding label of contacts to describe easily. The differential signal contact S23, S24 of the second contacts 322 is located in the middle of the differential signal contact S11, S12 and S15, S16 of the first contact 321 and arranged in one row. The upper contact 32 of the first contact 3 are arranged in five rows and each of two rows of the differential signal contact has a row of the grounding contact located therebetween.

Referring to FIGS. 5-6, the first shell 33 includes a first top end wall 331, a first bottom end wall 332 and two first side end walls 333 connecting with the first top end and bottom end walls 331, 332. The first top end wall 331 and the two side end walls 333 extend backwardly beyond the first bottom end wall 332. The first side end walls 333 each has a pair of first retaining arm 3331 extending backwardly and a pair of first resisting arms 3332 extending from a front edge thereof. The first top end wall 331 of the first shell 33 has a pair of first guiding arms 3311 extending outside from the front thereof. The upper insulative block 31 is mounted into the first shell 33 along the rear to front direction. The first resisting blocks 3113 are resisting a rear end of the first side end wall 333 of the first shell 33 forwardly. The first retaining blocks 3122 of the upper insulative block 31 are resisting the first bottom end wall 332 of the first shell 33.

Referring to FIG. 5, the first connector 3 is mounted into the insulative housing 1 from rear to front direction. The first retaining arm 3331 is received in the first passageway slot 171 and abuts against the inner surface of the first passageway slot 171. The first resisting arm 3331 of the first shell 33 abuts against the front wall 15 forwardly.

Referring to FIGS. 3-7, the second connector 4 includes a bottom insulative housing 41 having a third insulative block 411 and a fourth insulative block 412 mounted with the third insulative block 411, a plurality of bottom contacts 42 received in the bottom insulative housing 41 and a second shell 43 covering the second insulative housing 41. The third insulative block 411 includes a third body portion 4110 and a second tongue 4111 extending forwardly from the third body portion 4110. The bottom surface of the third body portion 411 includes a plurality of second receiving slots 4112 and a pair of the second resisting block 4113 extending outwardly from a rear thereof. The fourth insulative block 412 includes a second body portion 4120 having a plurality of second protruding portions 4121 matching up with the second receiving slots 4112 of the third insulative block 411. The second tongue 4111 includes a plurality of third accommodating slot 4114 located in an upper surface thereof and a plurality of fourth accommodating 4115 located in a bottom surface thereof. The fourth body portion 4120 has a plurality of second retaining blocks 4112 extending downwardly from a bottom thereof.

The bottom contact 42 includes a third group of contact having ten third contacts 421 and a fourth group of the contact having ten fourth contacts 422. The third contacts 421 each includes a third retaining portion 4212 retaining in the third body portion 4110, a third contacting portion 4211 extending forwardly from the third retaining portion 4212 and receiving in the third accommodating slot 4114 of the second tongue 4111, a third horizontal portion 4213 extending backwardly from the third retaining portion 4213 and extending out of the third body portion 4110 and a third extending portion 4214 extending downwardly and vertical of a rear of the third horizontal portion 4213 and a third soldering portion 4215. The third contacts 421 include a plurality of differential signal contacts and a plurality of grounding contacts. A pair of grounding contacts has a pair of differential signal contacts located therebetween. Respectively, the third contacts 421 are G31, S31, S32, G32, S33, S34, G33, S35, S36, G34. The third horizontal portion 4213 of the grounding contacts G31, G32, G33, G34 extend backwardly beyond the third horizontal portion 4213 of the differential signal contacts S31, S32, S35, S36. The third horizontal portion 4213 of the differential signal contacts S33, S34 extend backwardly beyond the third horizontal portion 4213 of the grounding contacts G31, G32, G33, G34. To observe along left and right directions, the corresponding third soldering portions 4215 are arranged in three rows along the front to rear direction. The third soldering portion 4215 of the grounding contacts G31, G32, G33, G34 are located in the middle row of the three rows.

The fourth contacts 422 each include a fourth retaining portion 4222 retained in the fourth body portion 4120, a fourth contacting portion 4221 extending forwardly from the fourth retaining portion 4222, a fourth horizontal portion 4223 extending backwardly from the fourth retaining portion 4223, a fourth extending portion 4224 extending downwardly and vertical of a rear of the fourth horizontal portion 4223 and a fourth soldering portion 4225. The fourth contacts 422 include a plurality of differential signal contacts and a plurality of grounding contacts. A pair of grounding contacts has a pair of differential signal contacts located therebetween. Respectively, the fourth contacts 422 are G41, S41, S42, G42, S43, S44, G43, S45, S46, G44. The third horizontal portion 4213 of the grounding contacts G41, G42, G43, G44 extend backwardly beyond the fourth horizontal portion 4223 of the differential signal contacts S41, S42, S45, S46. The fourth horizontal portion 4223 of the differential signal contacts S43, S44 extend backwardly beyond the fourth horizontal portion 4223 of the grounding contacts G41, G42, G43, G44. To observe along left and right directions, the corresponding fourth soldering portions 4225 are arranged in three rows along the front to rear direction. The fourth soldering portion 4225 of the grounding contacts G41, G42, G43, G44 are located in the middle row of the three rows.

The third insulative block 411 and the fourth insulative block 412 are mounted along the upper and bottom direction. The second protruding portions 4121 of the third insulative block 411 are received in the second receiving slot 4112 of the fourth insulative block 412 to make the third and fourth insulative blocks 411, 412 retain. The fourth contacting portion 4221 is received in the fourth accommodating slot 4115 of the second tongue 4111 and disposed outside downwardly. The differential signal contact S43, S44 of the fourth contacts 422 is located in the middle of the differential signal contact S41, S42 and S45, S46 of the third contact 421 and arranged in one row. The bottom contact 42 of the second contact 4 are arranged in five rows and each of two rows of the differential signal contact has a row of the grounding contact located therebetween.

Referring to FIG. 6, the second shell 43 includes a second top end wall 431, a second bottom end wall 432 and two second side end walls 433 connecting with the second top end and bottom end walls 431, 432. The second top end wall 431 and the two second side end walls 433 extend backwardly beyond the second bottom end wall 432. The second side end walls 433 each has a pair of second retaining arm 4331 extending backwardly and a pair of second resisting arms 4332 extending from a front edge thereof. The second top end wall 431 of the second shell 43 has a pair of second guiding arms 4311 extending outside from the front thereof. The bottom insulative block 41 is mounted into the second shell 43 along the rear to front direction. The second resisting blocks 4113 are resisting a rear end of the second side end wall 433 of the second shell 43 forwardly. The second retaining blocks 4122 of the bottom insulative block 41 are resisting the second bottom end wall 432 of the second shell 43.

Referring to FIG. 5, the second connector 4 is mounted into the insulative housing 1 from rear to front direction. The second retaining arm 4331 is received in the second passageway slot 172 and abuts against the inner surface of the second passageway slot 172. The second resisting arm 4331 of the Second shell 43 abuts against the front wall 15 forwardly.

The first and second connector 3, 4 are all assembled into the insulative housing 1, the differential signal contact S33, S34 of the third contact are located between the differential signal contact S21, S22 and S25, S26 of the second contact.

Referring to FIG. 10, the spacer 9 has a plurality of through holes 91 and a plurality of lump 92 extending outside thereof. The spacer 9 is mounted into the insulative housing 1 from the down to up direction. The limp 92 is received in the retaining slot 141 of the insulative housing 1. The first and second soldering portions 3215, 3225 and the third and fourth soldering portion 4215, 4225 pass through the through holes 91 along the up to down direction. The spacer 9 abut against second bottom end wall 432 of the second shell 43.

Figure 2:
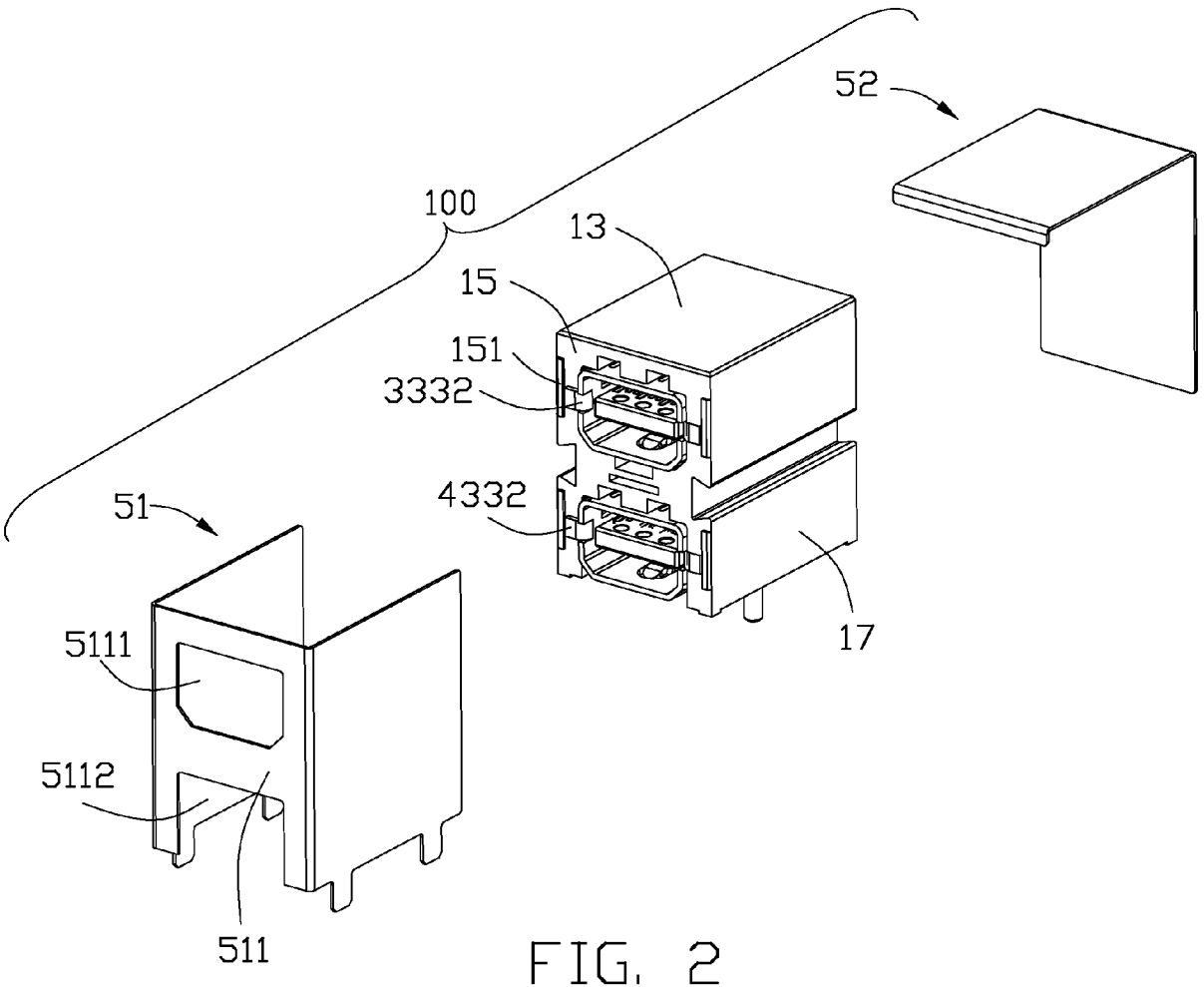
FIG. 2 is a partially exploded perspective view of the electrical connector.
Figure 3:
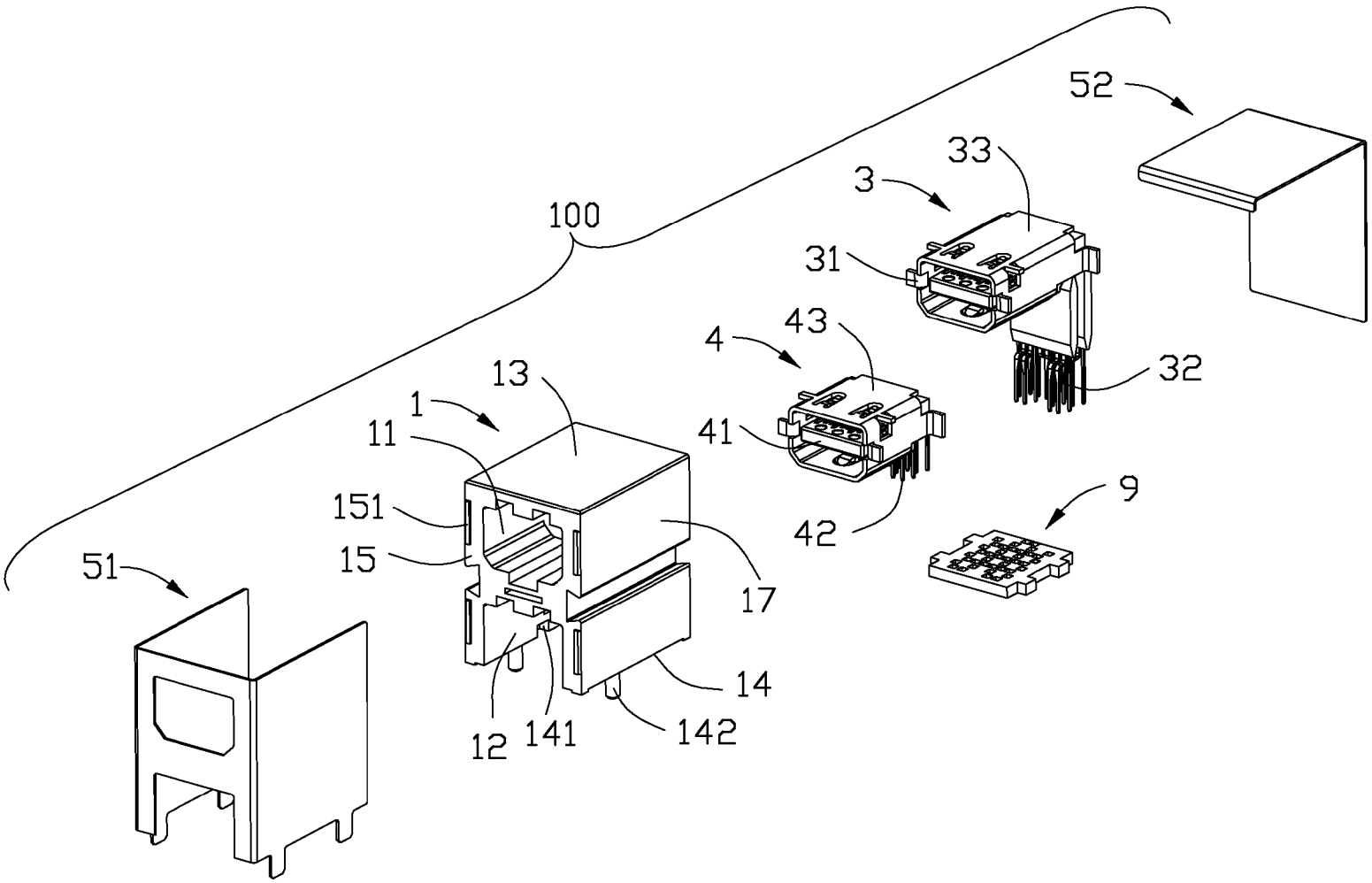
FIG. 3 is another partially exploded view of the electrical connector as shown in FIG. 2.
Figure 4:
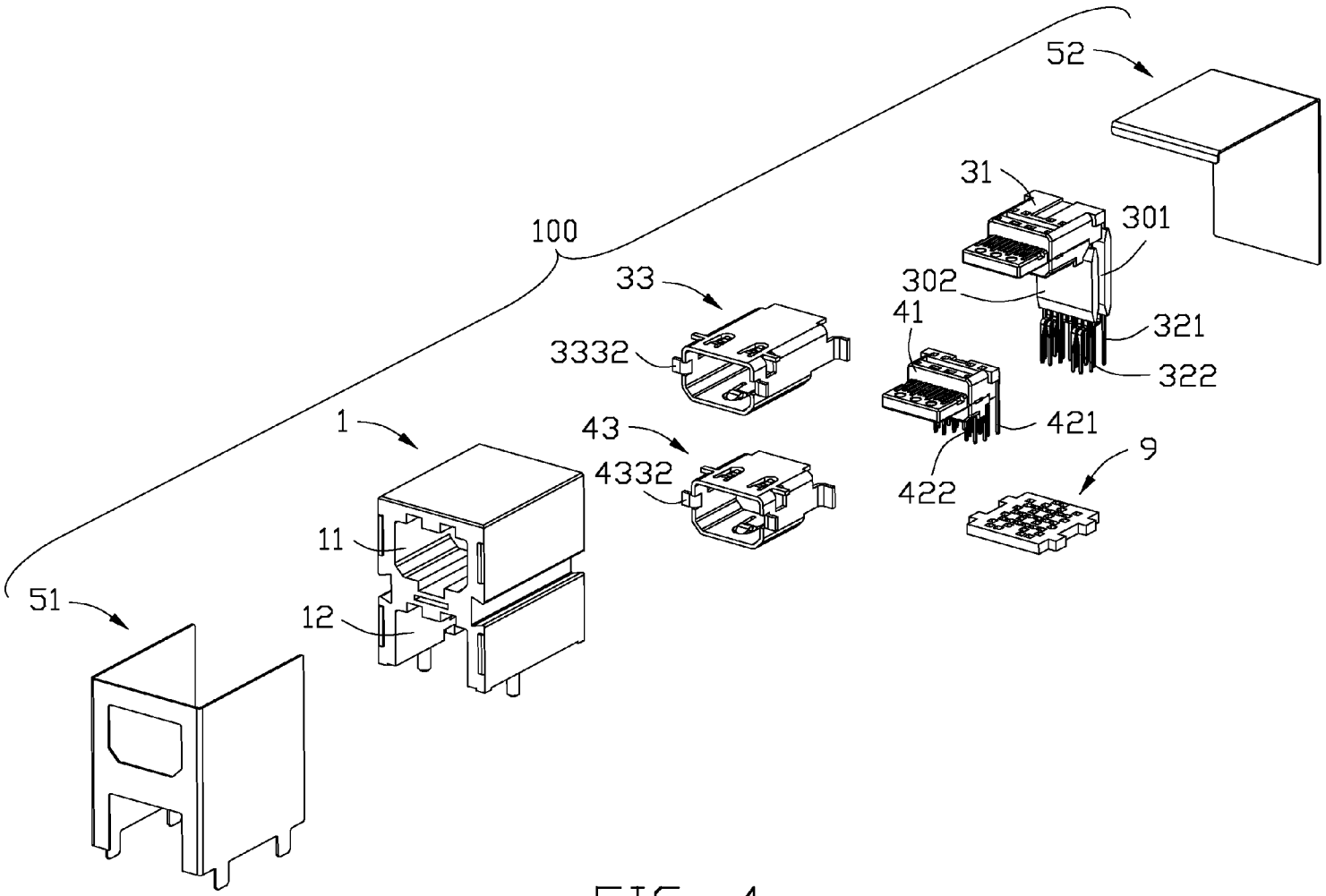
FIG. 4 is a further partially exploded perspective view of the electrical connector.

Referring to FIGS. 2-3, the covering shell 5 includes a shield shell 51 covering a front of the insulative housing 1 and a back shield shell 52 covering a rear of the insulative housing 1. The shield shell 51 has a front retaining surface 511 having a first and a second opening 5111, 5112. The first resisting arm 3332 of the first shell 33 and the second resisting arm 4332 of the second shell 43 is in a same surface of the convex 151 of the insulative housing 1.

The stacked connector include a first connector 3 having differential signal contacts and grounding contacts and a second connector 4 having differential signal contacts and grounding contacts. The grounding contacts are arranged to a plurality rows and the differential signal contacts are arranged to another rows which parallel to grounding contacts. The row of the differential contacts and the row of the grounding contacts are spaced from each other. As a result, cross-talk between the differential contacts can be reduced and it would be improve signal transmission quality of the electrical connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a first connector having an upper insulative block and a plurality of upper contacts received in the upper insulative block;

a second connector having a bottom insulative block and a plurality of the bottom contacts received in the bottom insulative block;

the upper and bottom contacts all include a plurality of differential signal contacts and grounding contacts, the differential signal contacts and grounding contacts arranged in a number of rows and spaced with each other; wherein some of the differential signal contacts of the upper contacts and some of the differential signal contacts of the bottom contacts are commonly arranged in one row.

2. The electrical connector as claimed in claim 1, wherein the upper contacts include a plurality of first contacts and second contacts, the first and second contacts each has a first and a second retaining portion retaining in the upper insulative block, a first and a second extending portion and a first and a second soldering portion.

3. The electrical connector as claimed in claim 2, wherein the bottom contacts include a plurality of third contacts and a plurality of fourth contacts, each of said third contacts has a third retaining portion retained in the bottom insulative block, a third horizontal portion and a third soldering portion, and each of said fourth contacts has a fourth retaining portion retained in the bottom insulative block, a fourth horizontal portion and a fourth soldering portion.

4. The electrical connector as claimed in claim 3, wherein some third horizontal portions of the differential signal contacts are shorter than the grounding contacts and another third horizontal portions of the differential signal are longer than the grounding contacts.

5. The electrical connector as claimed in claim 4, wherein some fourth horizontal portions of the differential signal contacts are shorter than the grounding contacts and another fourth horizontal portions of the differential signal are longer than the grounding contacts, the fourth soldering portion of the fourth contacts are arranged in three rows.

6. An electrical connector assembly comprising:

a first connector including:

an insulative housing defining a mating port and a mounting port;

opposite upper and lower level contacts disposed in the housing and arranged in two rows, each row of said upper and lower level contacts including a plurality of differential pairs and grounding contacts alternately arranged with each other along a transverse direction, each of said upper and lower level contacts including a front mating section exposed in the mating port so as to have the front mating sections of the upper level contacts and those of the lower level contacts spaced from each other in a vertical direction perpendicular to said transverse direction, and a rear mounting section exposed upon the mounting port so as to have the rear mounting sections of the upper level contacts and those of the lower level contacts spaced from each other in a front-to-back direction perpendicular to both said transverse direction and said vertical direction; wherein in each row of said upper and lower level contacts, the mounting sections of the differential pairs are arranged in two opposite front and rear rows with those of the grounding contacts arranged in a middle row therebetween in said front-to-back direction; wherein the mounting sections of the lower level contacts in the corresponding rear row and the mounting sections of the upper level contacts in the corresponding front row are aligned with each other in the transverse direction.

7. The electrical connector assembly as claimed in claim 6, wherein the mounting sections of the lower level contacts in the corresponding rear row and the mounting sections of the upper level contacts in the corresponding front row are arranged with each other in a sandwiched manner therebetween along the transverse direction.

8. The electrical connector assembly as claimed in claim 6, further including a second connector stacked upon the first connector in the vertical direction, wherein the second connector includes at least one row of upmost contacts above the upper level contacts, said uppermost contacts including a plurality of differential pairs and grounding contacts alternately arranged with each other in the transverse direction and each of said uppermost contacts including a front mating section and a rear mounting section, the rear mounting sections of the differential pairs of the uppermost level contacts being arranged with two opposite front and rear row commonly sandwiching another row defined by those of the grounding contacts of the uppermost contacts in the front-to-back direction, wherein the mounting sections of the upper level contacts in the corresponding rear row are aligned with the mounting sections of the uppermost level contacts in the corresponding front row along said transverse direction.

9. The electrical connector assembly as claimed in claim 6, wherein in said first connector, the rear mounting sections of both said upper level contacts and said lower level contacts are arranged totally in five lines along said transverse direction, said five lines including a first line, a second line, a third line, a fourth line and a fifth line in sequence along said front-to-back direction.

10. The electrical connector assembly as claimed in claim 9, wherein the first line, the third line and the fifth line are related to the differential pairs while the second line and the fourth line are related to the grounding contacts.

11. The electrical connector assembly as claimed in claim 10, wherein an amount of the rear mounting sections in the first line is less than an amount of the rear mounting sections in the fifth line which is less than an amount of the rear mounting sections in the third line.

12. The electrical connector assembly as claimed in claim 11, wherein an amount of the rear mounting sections in the second line is equal to that in the fourth line.

13. An electrical connector assembly comprising:

a first connector including:

an insulative housing defining a mating port having two opposite first and second sides, and a mounting port;

a plurality of first contacts disposed in the housing and arranged on the first side, a plurality of second contacts disposed in the housing and arranged on the second side, said first contacts including a plurality of differential pairs and grounding contacts alternately arranged with each other along a transverse direction, said second contacts including a plurality of differential pairs and grounding contacts alternatively arranged with each other along said transverse direction, each of said first contact and said second contact including a front mating section exposed in the mating port so as to have the front mating sections of the first contacts aligned with one another on the first side and the front mating sections of the second contacts aligned with one another on the second side, and a rear mounting section exposed upon the mounting port so as to have the rear mounting sections of the first contacts and those of the second contacts spaced from each other in a front-to-back direction perpendicular to said transverse direction, each of the rear mounting section of the first contact and the rear mounting section of the second contact extending in a vertical direction perpendicular to both said transverse direction and said front-to-back direction; wherein in either one of said first contacts and said second contacts, the mounting sections of the differential pairs are arranged in two opposite front and rear rows with those of the grounding contacts arranged in a middle row therebetween in said front-to-back direction; wherein the mounting sections of the first contacts in the corresponding rear row and the mounting sections of the second contacts in the corresponding front row are aligned with each other in the transverse direction.

14. The electrical connector assembly as claimed in claim 13, wherein the front mating section of said first contact and the front mating section of said second contact extend along said front-to-back direction.

15. The electrical connector assembly as claimed in claim 13, wherein the mounting sections of the first contacts in the corresponding rear row and the mounting sections of the second contacts in the corresponding front row are arranged with each other in a sandwiched manner therebetween along the transverse direction.

16. The electrical connector assembly as claimed in claim 13, wherein said front mating section and said rear mounting section are arranged with regard to each other in said front-to-back direction.

17. The electrical connector assembly as claimed in claim 13, further including a second connector located beside the first connector and closer to the second contacts than to the first contacts, wherein the second connector includes at least a plurality of third contacts, said third contacts including a plurality of differential pairs and grounding contacts alternately arranged with each other in the transverse direction and each of said third contacts including a front mating section and a rear mounting section, the rear mounting sections of the differential pairs of the third contacts being arranged with two opposite front and rear row commonly sandwiching another middle row defined by the rear mounting sections of the grounding contacts of the third contacts in the front-to-back direction, wherein the mounting sections of the second contacts in the corresponding rear row are aligned with the mounting sections of the third contacts in the corresponding front row along said transverse direction.

18. The electrical connector assembly as claimed in claim 13, wherein each of the rear mounting section of the first contact and the rear mounting section of the second contact defines a straight mounting end extending in the vertical direction.

19. The electrical connector assembly as claimed in claim 13, wherein in said first connector, the rear mounting sections of both said first contacts and said second contacts are arranged totally in five lines along said transverse direction, said five lines including a first line, a second line, a third line, a fourth line and a fifth line in sequence along said front-to-back direction; wherein the first line, the third line and the fifth line are related to the differential pairs while the second line and the fourth line are related to the grounding contacts.

20. The electrical connector assembly as claimed in claim 19, wherein an amount of the rear mounting sections in the first line is less than an amount of the rear mounting sections in the fifth line which is less than an amount of the rear mounting sections in the third line.

* * * * *